United States Patent [19]

Chartrand et al.

[11] 4,351,250

[45] Sep. 28, 1982

[54] PROCESS AND APPARATUS FOR RECYCLING ORGANIC WASTES

[76] Inventors: Joseph A. Chartrand, St. Hugues, County of Bagot, St. Hugues, Canada, J0H 1N0; Irénée Perreault, 1025 Lapierre St., St. Hyacinthe, Canada, J2T 3N6

[21] Appl. No.: 259,833

[22] Filed: May 4, 1981

[51] Int. Cl.[3] ..... F23G 5/04

[52] U.S. Cl. ..... 110/227; 110/228; 110/218; 110/215

[58] Field of Search ..... 110/218, 224, 227, 228, 110/215

[56] References Cited

U.S. PATENT DOCUMENTS

| | | | |
|---|---|---|---|
| 653,015 | 7/1900 | Besemfelder | 110/218 |
| 940,945 | 11/1909 | Shepard et al. | 110/228 |
| 946,788 | 1/1910 | Shepard et al. | 110/228 |
| 3,656,440 | 4/1972 | Grey | 110/215 |
| 3,656,441 | 4/1972 | Grey | 110/215 |
| 4,060,042 | 11/1977 | Baraldi et al. | 110/224 |
| 4,091,748 | 5/1978 | Mansfield | 110/228 |
| 4,098,200 | 7/1978 | Danvergne | 110/228 |
| 4,156,392 | 5/1979 | Bayeh | 110/228 |

*Primary Examiner*—Henry C. Yuen

[57] ABSTRACT

This defines a process and an apparatus to treat wet organic wastes, such as manures, to protect the environment and to recycle the solid content in the form of a soil conditioner or fertilizer. This process and apparatus are made to remove the bad smell and to separate the solid content in a very dry form, adapted to be readily bagged. This process and apparatus are characterized by an efficient conveying and concurrent agitation of the organic wastes in an evaporation furnace and in combination with use of the combustion gases for heat exchange heating of the fluidizing content of the wet organic wastes.

2 Claims, 11 Drawing Figures

PROCESS AND APPARATUS FOR RECYCLING ORGANIC WASTES

This invention relates to the disposal of wet organic wastes, such as manure and excreta, and more particularly to a process and an apparatus of the type adapted to recycle organic wastes, such as in the form of a soil conditioner or fertilizer.

It is no secret for just about anyone that barns and, in particular, piggeries are now concentrating larger and larger herds to optimize the profits. Such concentration steeply increases the risks of air and soil pollution by the large quantities of manure that are produced by such herds. Such manure and other excretas must now be safely disposed of to protect our environment.

The processes and apparatuses that have been proposed in the prior art are not found satisfactory to reduce the pollution by manure or excreta.

A general object of the present invention is to provide a process and an apparatus adapted to make the above-mentioned wet organic wastes totally harmless to the environment.

Another general object of the present invention is to provide a process and an apparatus that are adapted to recycle the solid content of wet organic wastes, such as manure and excreta, in the form of a soil conditioner or fertilizer readily clear of unpleasant smell.

Still another general object of the present invention is to provide an apparatus which is particularly constructed and arranged to be efficiently and competitively operated, considering the available alternatives and the market value of the solid content that is retrieved and recycled as a soil conditioner or organic fertilizer.

The above and other objects and advantages of the present invention will be better understood with reference to the following detailed description of a preferred embodiment thereof, which is illustrated, by way of example, in the accompanying drawings, in which.

Figure 1:
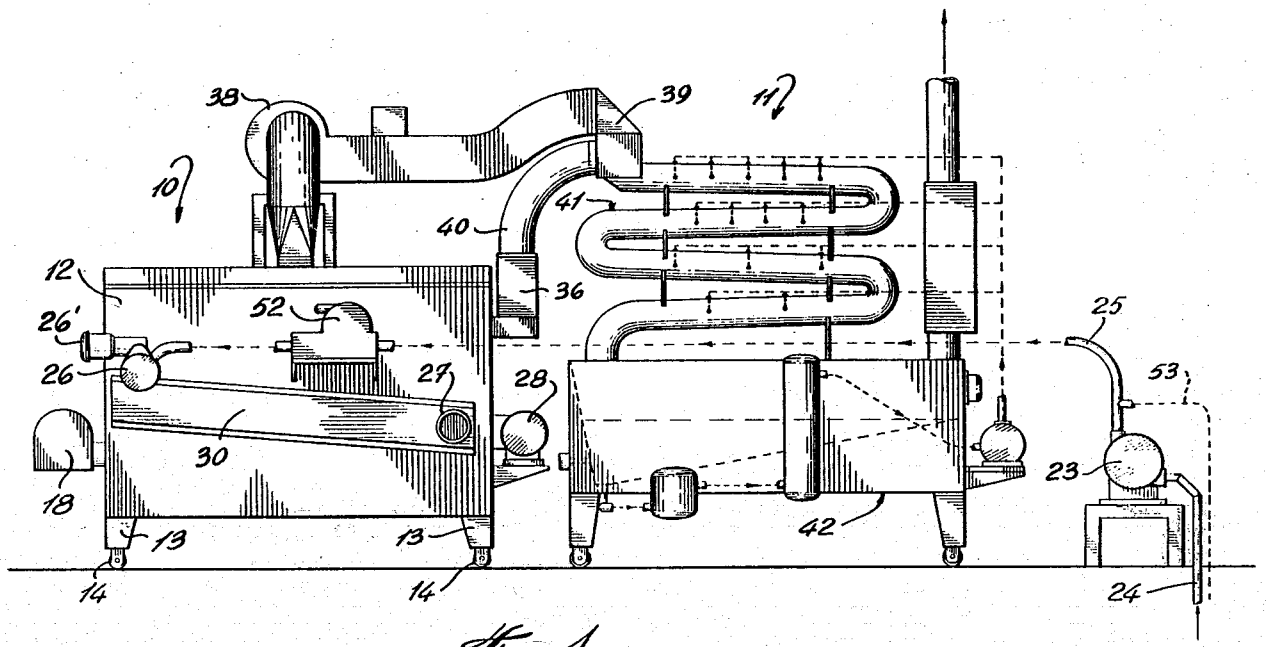
FIG. 1 is a side elevation view of an apparatus according to the present invention constructed and arranged to recycle organic wastes, such as manure, according to the process of the present invention.
Figure 2:
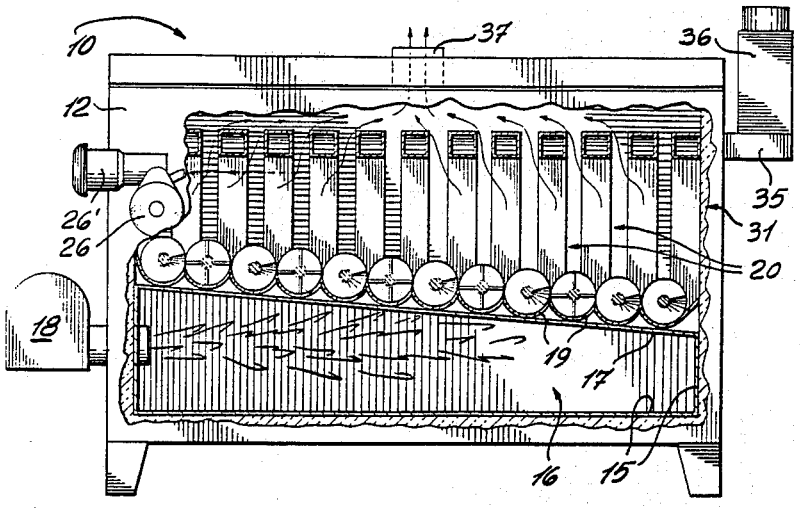
FIG. 2 is a side elevation view of the evaporation furnace of FIG. 1 with parts broken away and in cross-section to illustrate the internal construction.
Figure 3:
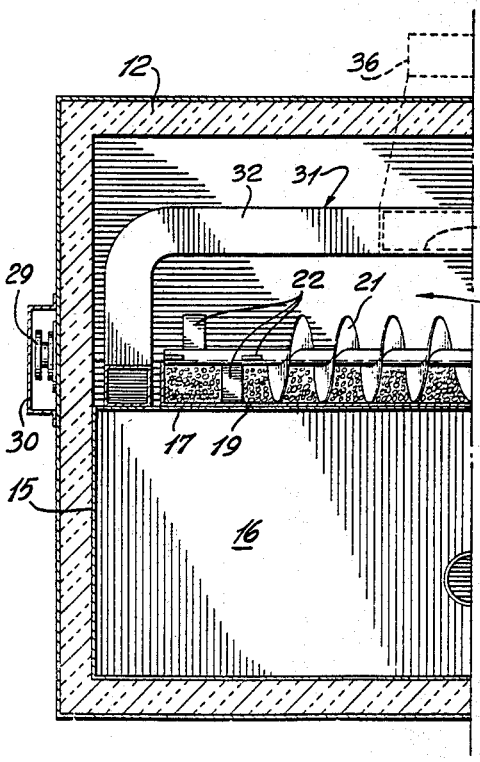
FIG. 3 is a transverse cross-section of one half of the evaporation furnace of FIG. 2.
Figure 6:
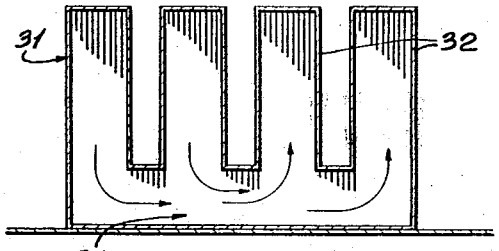
Figure 7:
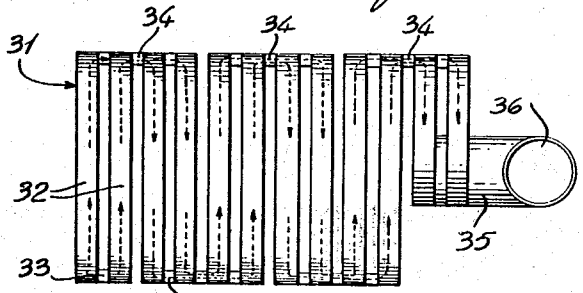
Figure 5:
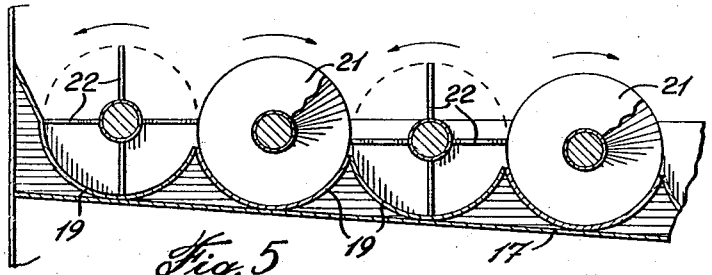
Figure 4:
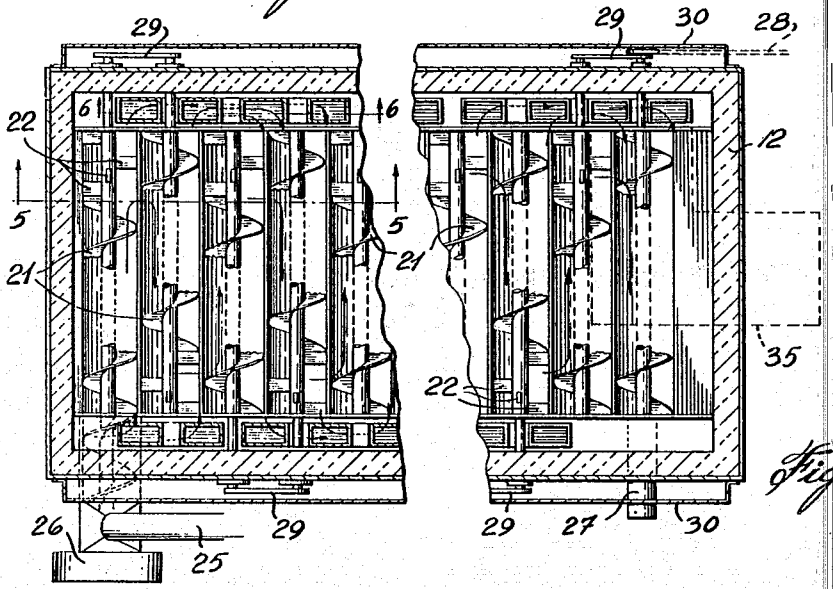
FIG. 4 is a cross-sectional view in a horizontal plane of the same evaporation furnace for wet organic wastes.
Figure 8:
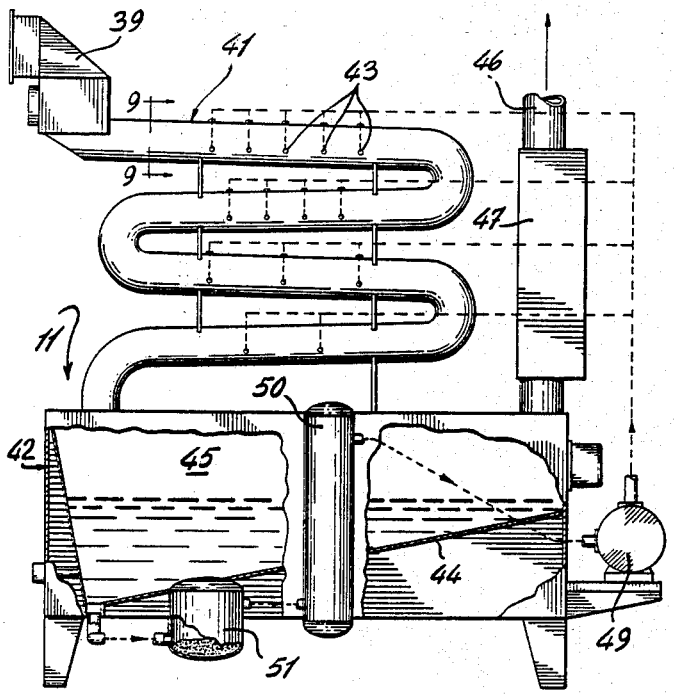
Figure 9:
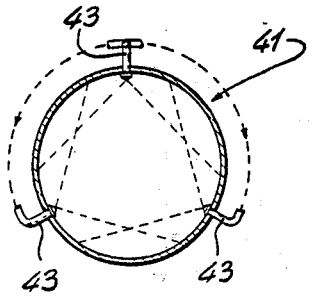
Figure 10:
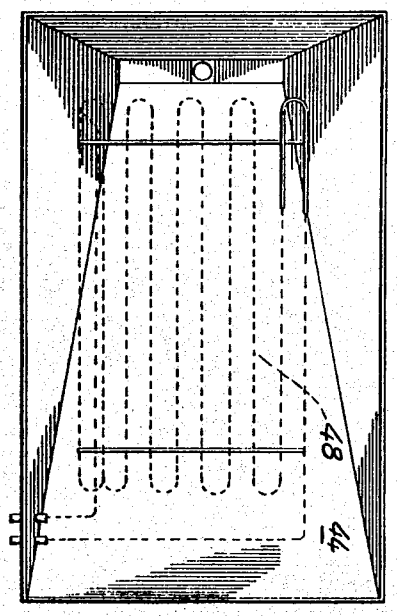
Figure 11:
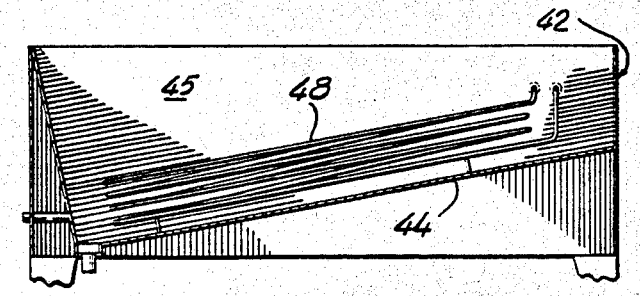

FIGS. 5 and 6 are cross-sectional views as seen along lines 5—5 and 6—6, respectively, in FIG. 4;

FIG. 7 is a top view of a heat exchanger duct system forming part of the illustrated evaporation furnace;

FIG. 8 is a side elevation view of a gas scrubber forming part of the apparatus of FIG. 1;

FIG. 9 is a transverse cross-sectional view through a precipitation duct forming part of the gas scrubber of FIGS. 1 and 8; and FIGS. 10 and 11 are plan and side views, respectively, of a heat exchanger embodied into the same gas scrubber.

The present invention defines an apparatus and a process to recycle organic wastes by circulating wet organic wastes, such as manure, in a continuous flow through a vaporization furnace, separating the fluidizing content from the solid content by vaporization, collecting the solid content for recycling of the same as a soil conditioner or organic fertilizer, mixing the fluidizing content with combustion gases from the furnace, purifying the fluidizing content and combustion gases by circulation through a gas scrubber, circulating the combustion gases in heat exchange relationship with the fluidizing content through the furnace, continuously agitating the organic wastes concurrently with their conveyance through the vaporization furnace, and providing a conveyor concurrently producing the continuous agitating of the organic wastes in addition to its conveying action.

The illustrated apparatus according to the present invention is adapted to recycle organic wastes, such as manure. The illustrated apparatus comprises a vaporization furnace 10 operatively connected to a gas scrubber 11.

The vaporization furnace 10 includes a fire-resistant rectangular housing 12, of conventional construction and materials. The housing 12 is mounted on feet 13 provided with sturdy rollers 14 to be adjustably positioned. A metal box 15 is fitted at the bottom of the furnace and internally forms a combustion chamber 16. The top 17 of the box 15 cooperatively forms a stand or support, as best described hereafter. An oil burner 18 is conventionally secured to the front face of the vaporization furnace 10 with its fuel jet internally directing the combustion. A plurality of troughs 19 are mounted on the top 17 of the box 15 and cooperatively form therewith a stand or support carrying the wet organic wastes. As best shown in FIGS. 2, 3, 4, and 5, the troughs 19 longitudinally extend transversely of the furnace and define opposite ends ending short of the corresponding inner wall of the furnaces. The stand or support thus divides the furnace into the underlying combustion chamber 16 and an overlying vaporization chamber 20. The troughs 19 are positioned side by side at a gradually-reducing height from an uppermost upstream trough at the front of the furnace to a lowermost downstream trough at the rear of the furnace. As seen in FIG. 5, this reduction in height also applies to the top of the side walls of the troughs which results in each trough having its rearward side lower than its forward side. Thus, the organic wastes can be spilled laterally from one trough to the next in the front-to-rear direction defined by the vaporization furnace should movement of the organic waste along a trough become obstructed. Each trough defines an upstream end and a downstream end and such that each trough has its downstream end adjacent to the upstream end of the next trough. This upstream and downstream arrangement of the ends of the trough is obtained by appropriate arrangement and rotation of one endless screw conveyor 21 in each trough. Each endless screw conveyor 21 extends with its upstream end starting at the upstream end of the corresponding trough and its downstream end ending short of the downstream end of the corresponding trough.

Rotary paddles 22 forming waste transfer elements are fixed at the downstream end of each endless scree conveyor 21 to transfer, push or spill organic wastes from the corresponding downstream end of each trough in the upstream end of the next trough. Thus, as shown by the arrows in FIG. 4, the organic wastes will be conveyed back and forth transversely of the furnace in the successive troughs from the upstream end of the uppermost upstream trough to the downstream end of the lower-most downstream trough. In the illustrated embodiment, the manure is pumped by a pump 23 through a suction pipe 24 from a manure-collecting pit, not shown, to be fed to a pipe 25 connected to a pulsating pump 52 that feeds measured amounts of manure to an endless auxiliary screw 26 positioned above the uppermost upstream screw 21 to distribute the manure along the same. A bypass pipe 53 is provided to return any excess produced by pump 23. A gear motor 26' drives endless screw 26. A pipe 27 outwardly extends through one side wall of the furnace at the downstream end of the lowermost downstream trough 19 in alignment with the latter. Thus, the dried solid content of the wet organic wastes is discharged at the outlet 27, in the form of dried granular, to be readily bagged, after vaporization of the fluidizing content into the vaporization chamber 20. A motor 28 drives the lowermost downstream screw 21 directly and the other endless screws 21 indirectly through rotation, reversing couplings 29 mounted in protective casings 30 secured longitudinally against the opposite sides of the furnace.

A heat exchanger ducting 31 is mounted in the vaporization chamber 20 over the troughs 19. The ducting 31 includes a pair of ducts 32 extending from an inlet end collector 33, intermediate transfer bridges 34, to an outlet end collector 35 in open communication with a chimney 36. The inlet end collector 33 communicates through openings in the top 17 with the combustion chamber 16. Thus, the combustion gases and smoke pass in the ducting 31 to the chimney 36. This allows further heating of the fluidizing content in the vaporization chamber by the heat of the combustion gases flowing in the ducting 31. Therefore, sterilization of the fluidizing content can be achieved. An outlet 37 is provided through the top of the furnace for the fluidizing content. A blower 38 is connected to the outlet 37 and to a mixing inlet box 39 to blow the fluidizing content into that box and mix it there with the combustion gases coming by a duct 40 from the chimney 36.

The gas scrubber 11 is connected to the mixing inlet box 39 to purify the gases that arrive there. For that purpose, the gas scrubber 11 comprises an upstream precipitation duct section 41 and a downstream sedimentation section 42. In the precipitation duct section, precipitation is enhanced by water jets 43 spaced along the duct 41. The precipitation including condensed water flows down the duct 41 into a sedimentation tank 44 above which there is a gas compartment 45. A chimney 46 evacuates the remaining gases into the atmosphere after passage through an electrostatic precipitator 47 of conventional construction.

A heat exchanger 48 is immersed in the sedimentation tank 44 to recuperate some heat. A pump 49 recirculates the condensed liquid through the water jets 43 after clarification through two stages of sedimentation in tank 44 and a further tank 50 and filtration through a filter 51.

What we claim is:

1. An apparatus for treating organic wastes having a high liquid content to recuperate the solid contents thereof in dried condition, comprising a furnace defining an enclosed space, a series of troughs disposed side by side and mounted in the furnace and separating the interior of the furnace into an underlying combustion chamber and an overlying vaporization chamber, means to burn fuel in said combustion chamber, said troughs serially communicating one with another and containing the organic waste in the furnace in open communication with the overlying vaporization chamber, each trough, except the last trough of the series, having its downstream end in lateral communication with the upstream end of the next trough of the series, the last trough of the series having its downstream end opening outside said furnace for discharge of the dried solid content of the organic waste, means to discharge untreated solid waste in the first trough of the series, a conveyor system mounted in the trough and operatively conveying the organic waste in continuous flow for vaporization of fluidizing content and separation of the latter from the solid content, said conveyor system including a plurality of endless screw conveyors extending longitudinally into the troughs respectively, power means to drive the endless scrw conveyors to convey the organic waste from the upstream end to the downstream end of each trough, paddles fixed to the downstream end of each endless screw conveyor, except the endless screw conveyor in the last trough of the series, for pushing the organic waste from one trough to the next through said lateral communication, a heat exchanger ducting extending in the vaporization chamber over the organic waste in the troughs and including an inlet communicating with the combustion chamber, and an outlet located outside said furnace, whereby the hot combustion gases flow from said combustion chamber through said ducting prior to be discharged through said outlet to provide additional heating of the vapors in the vaporization chamber, said furnace further having an outlet at the top of said vaporization chamber for the evacuation of vaporized fluidizing content, the troughs are horizontally disposed in their longitudinal direction, but are arranged at lowering levels relative to one another serially from an uppermost upstream trough to a lowermost upstream trough, the top of the side walls of said troughs being also arranged at lowering levels, whereby organic wastes in an obstructed trough can spill over laterally into an adjacent downstream trough.

2. An apparatus as claimed in claim 1, wherein said heat exchanger ducting includes a series of inverted U-shape ducts in spaced side-by-side relationship within said vaporization chamber.

* * * * *